US005178089A

United States Patent [19]

Hodel

[11] Patent Number: 5,178,089

[45] Date of Patent: Jan. 12, 1993

[54] MOTOR BOAT HYDROFOIL

[76] Inventor: Arnold Hodel, 922 S. Benton Dr., Sauk Rapids, Minn. 56379

[21] Appl. No.: 756,812

[22] Filed: Sep. 9, 1991

[51] Int. Cl.[5] ..... B63B 1/24

[52] U.S. Cl. ..... 114/274; 114/280; 440/66

[58] Field of Search ..... 114/274, 285-287, 114/280-282; 440/66, 76, 78, 71

[56] References Cited

U.S. PATENT DOCUMENTS

| | | | |
|---|---|---|---|
| 1,549,564 | 8/1925 | Slocum . | |
| 2,274,200 | 2/1942 | Hill | 114/66.5 |
| 2,584,347 | 2/1952 | Hazard | 114/66.5 |
| 2,860,594 | 11/1958 | Kiekhaefer | 440/78 X |
| 3,019,755 | 2/1962 | Diamond | 114/66.5 |
| 3,433,195 | 3/1969 | Poole | 114/66.5 |
| 4,048,939 | 9/1977 | Jones, Jr. | 114/125 |
| 4,487,152 | 12/1984 | Larson | 440/66 X |
| 4,738,644 | 4/1988 | Happel | 440/900 |
| 4,744,779 | 5/1988 | Koehler | 440/76 |
| 4,756,265 | 7/1988 | Lane | 114/57 |
| 4,977,847 | 12/1990 | Bartlett | 114/274 |
| 4,995,840 | 2/1991 | Seale et al. | 440/66 |
| 5,048,449 | 9/1991 | Templeman | 114/274 X |

FOREIGN PATENT DOCUMENTS

| | | | |
|---|---|---|---|
| 0039394 | 2/1987 | Japan | 440/66 |

*Primary Examiner*—Sherman Basinger

[57] ABSTRACT

The invention relates to a pair of five-sided hydrofoils for use in conjunction with the lower unit of a conventional outboard motor. The invention improves the stability of a boat and reduces the time required for a boat to achieve a planar configuration with respect to the surface of a body of water. The hydrofoils include leading edges having upturned angular portions and trailing edges having downturned angular portions. The leading and trailing edges are designed to simultaneously apply a lifting force to the stern and a downward force to the bow of a boat as the boat is propelled through the water. The invention improves the performance, safety, comfort, and useful life of a boat and a conventional outboard motor.

8 Claims, 1 Drawing Sheet

MOTOR BOAT HYDROFOIL

BACKGROUND OF THE INVENTION

This invention relates to hydrofoil devices for use with conventional outboard motors; more particularly, the invention relates to a pair of mirror-image outboard motor hydrofoils for attachment to the cavitation plate of a conventional outboard motor. The hydrofoils remain submerged directing water flow passage while in use. By directing water flow passage the hydrofoils enhance the lifting forces applied to the stern of a boat thereby improving the boat's ability to achieve a planar configuration with respect to the surface of a body of water.

Devices designed for stabilization and trimming of boats using inboard and outboard propulsion systems have been known in the art. Examples of prior art devices of this type include United States Patents by Seale et al, U.S. Pat. No. 4,995,840; Bartlett, U.S. Pat. No. 4,977,847; Lane, U.S. Pat. No. 4,756,265; Happel, U.S. Pat. No. 4,738,644, and Poole, U.S. Pat. No. 3,433,195. The prior art attempts to direct water flow across the device in order to achieve the desired trimming and stabilization effects. Former devices do not employ the use of an upturned angle portion along the leading edge in conjunction with a downturned angle portion along the trailing edge in order to direct water flow. The prior art devices lacked efficiency in design and thereby did not maximize lifting forces to the stern of a boat during use, while simultaneously minimizing drag.

SUMMARY OF THE INVENTION

The invention relates to a pair of five-sided hydrofoils for use in conjunction with the lower unit of a conventional outboard motor. The invention improves the stability of a boat and reduces the time required for a boat to achieve a planar configuration with respect to the surface of a body of water. The hydrofoils include leading edges having upturned angular portions and trailing edges having downturned angular portions. The leading and trailing edges are designed to simultaneously apply a lifting force to the stern and a downward force to the bow of a boat as the boat is propelled through the water. The invention improves the performance, safety, comfort, and useful life of a boat and a conventional outboard motor.

An object of the invention is to improve safety by maximizing visibility and minimizing the time required for a boat to achieve a planar configuration with respect to the surface of a body of water after acceleration.

Another object of the invention is to enhance the planing abilities of a boat by increasing the water pressure forces to the underside of the hydrofoils thereby magnifying the lifting forces to the stern.

Still another object of the invention is to direct the flow of water passing the lower unit of an outboard motor while simultaneously minimizing drag to the boat and engine.

Still another object of the invention is to save fuel, engine, and boat wear while providing enhanced comfort to passengers occupying a boat.

Still another object of the invention is to provide a simple, economical, easily serviceable, and safe pair of hydrofoils for use with a conventional outboard motor.

A feature of the invention is a pair of planar five-sided hydrofoils preferably made of stainless steel or aluminum.

Another feature of the invention is a mounting edge used for attaching the hydrofoils to the cavitation plate of a conventional outboard motor.

Still another feature of the invention is a leading edge having an angled portion upturned approximately 12° with respect to the planar hydrofoils.

Still another feature of the invention is a trailing edge having an angled portion downturned approximately 12° with respect to the planar hydrofoils.

DETAILED DESCRIPTION OF THE PREFERRED EMBODIMENT

Figure 3:
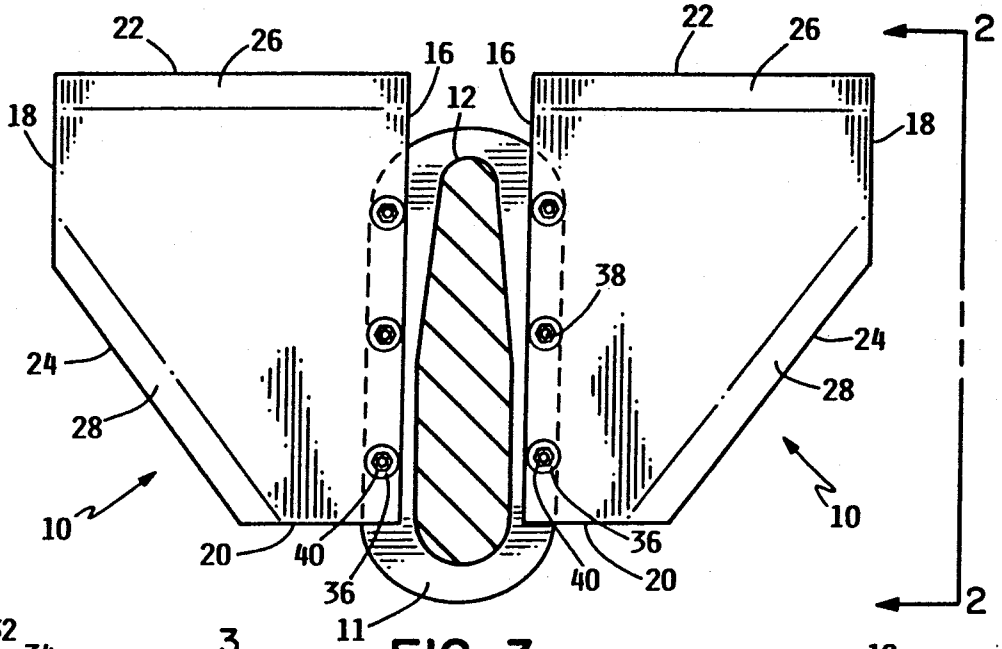
FIG. 3 is a cross-sectional partial phantom line top view of the invention taken along the line 3—3 of FIG. 2.
Figure 1:
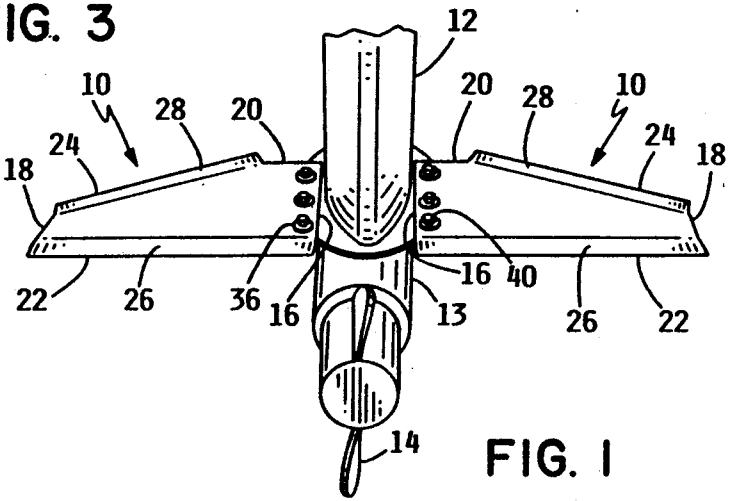
FIG. 1 is an environmental view of a pair of hydrofoils suitably affixed to the cavitation plate of an outboard motor propulsion system.

One form of the invention is illustrated and described herein. The improved hydrofoils are indicated in general by the numeral 10. The hydrofoils 10 are a mirror-image pair preferably mounted on opposite sides of a conventional outboard motor having a longitudinally, horizontally-extending cavitation plate 11, a vertically-depending drive shaft housing 12, a lower gear case housing 13, a propeller 14 located at the rear of the gear case housing 13, and a depending skeg 15. (FIG. 2) The conventional outboard motor and the above-referenced elements, are well known in the art.

All portions of the hydrofoils 10 are preferably fabricated of stainless steel metal or aluminum and remain of suitable thickness to not bend or fracture when exposed to strenuous operating conditions.

Figure 2:
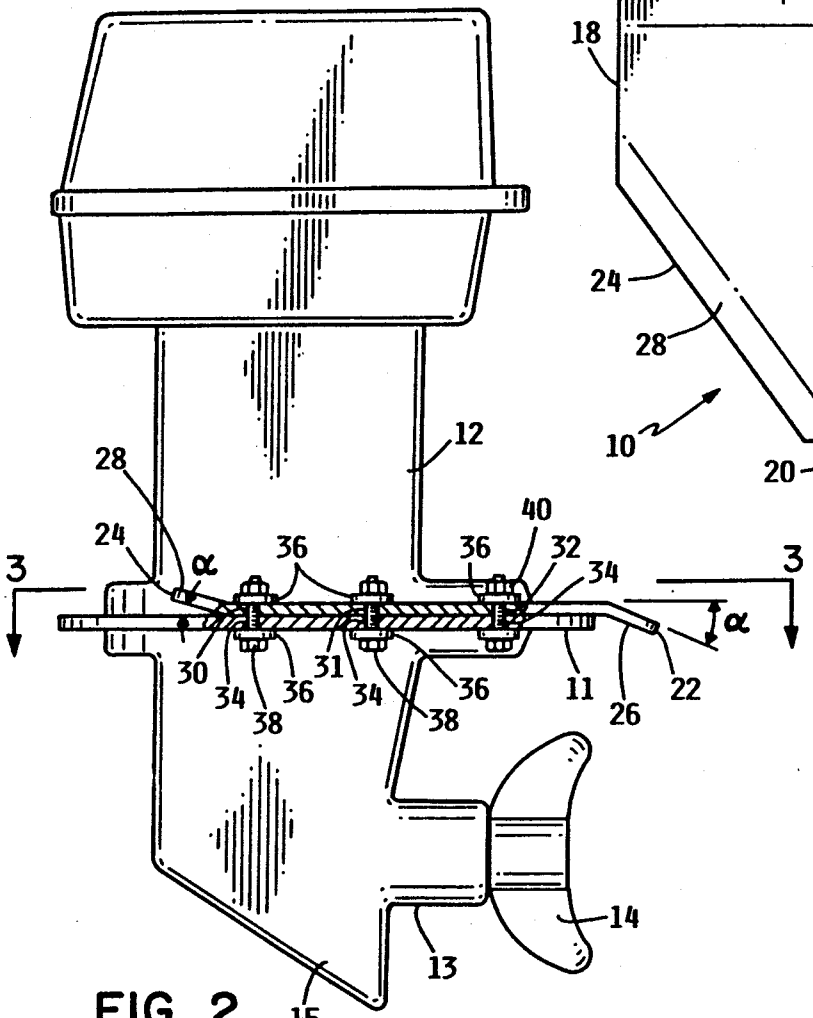
FIG. 2 is a broken-away side view of the invention taken along the line 2—2 of FIG. 3.

The pair of hydrofoils 10 are generally of one-piece planar construction having five sides. Each hydrofoil 10 is comprised of a mounting side 16, a second side 18, a forward edge 20, a trailing edge 22, and a leading edge 24. (FIG. 3) The trailing edge 22 contains a downturned angle portion 26 and the leading edge 24 contains an upturned angle portion 28. (FIGS. 2, 3)

The mounting side 16 remains generally straight and is located proximal to the drive shaft housing 12. The mounting side 16 is preferably $9\frac{3}{4}$ inches in length and is suitably parallel to the second side 18. The mounting side 16 is defined by the forward edge 20 at one end and the trailing edge 22 at the opposite end. The mounting side 16 preferably contains three openings 30, 31, and 32 for suitable engagement with the cavitation plate 11 for mounting of the hydrofoils 10 to a boat motor. The mounting side 16 preferably remains in flush contact with the cavitation plate 11 upon mounting.

The second side 18 remains generally straight and is a preferred length of $3\frac{1}{8}$ inches. The second side 18 is defined by the leading edge 24 at one end and the trailing edge 22 at the opposite end. (FIG. 3)

The forward edge 20 is generally straight and preferably remains perpendicular to the mounting side 16. The forward edge 20 is also suitably parallel to the trailing edge 22 and is defined by the mounting side 16 at one end and the leading edge 24 at the opposite end. The forward edge 20 is preferably $2\frac{3}{4}$ inches in length.

The trailing edge 22 remains generally straight and is suitably perpendicular to the mounting side 16. The trailing edge 22 is preferably 9¾ inches in length and contains a downturned angle portion 26 over its entire length. The trailing edge 22 is defined by the mounting side 16 at one end and the second side 18 at the opposite end. The downturned angle portion 26 depends from the plane of the hydrofoil 10 by angle alpha. The depending angle alpha is preferably 12° with respect to the plane of the hydrofoil 10. Angle alpha may also suitably vary within the range of 12°±2°. The width of the downturned angle portion 26 is suitably 1½ inches and is preferably formed by bending of the trailing edge 22 downward to form the desired angle alpha.

The leading edge 24 remains generally straight extending angularly back from the forward edge 20 as seen in FIG. 3. The leading edge 24 is defined by the forward edge 20 opposite the mounting side 16 at one end and the second side 18 opposite the trailing edge 22 at the opposite end. The leading edge 24 suitably contains an upturned angle portion 28 over its entire length. The upturned angle portion 28 extends upward from the plane of the hydrofoil 10 by angle alpha. Angle alpha preferably remains 12° with respect to the plane of the hydrofoil 10. Angle alpha may also suitably vary within the range of 12°±2°. The width of the upturned angle portion 28 is suitably 13/16's of an inch and is preferably formed by bending of the leading edge 24 upward to form the desired angle alpha.

Three openings 30, 31, and 32 are located proximal to the mounting sides 16 of the hydrofoil 10. (FIG. 3) The opening 30 is preferably located ½ inch from the forward edge 20. The opening 31 is preferably located 3¼ inches from the opening 30 and the opening 32 is preferably located 3 inches from the opening 31. The openings 30, 31, and 32 are all preferably located ¾ inch interior to the mounting sides 16.

The hydrofoils 10 may be suitably mounted to any conventional size cavitation plate 11 which horizontally and longitudinally extends from a motor drive shaft housing 12, irrespective of the shape and/or size of the motor drive shaft housing 12 on which the cavitation plate 11 is mounted.

In order to initiate mounting of the hydrofoils 10 to an outboard motor, three openings 34 are required to be placed through the cavitation plate 11 on each of the opposite sides of the drive shaft housing 12, suitably corresponding to the spacing of the openings 30, 31, and 32. The openings 34 may be suitably drilled by any conventional manner by temporarily positioning the mounting sides 16 of the hydrofoil 10 on top of the cavitation plate 11. The openings 30, 31, and 32 may then be suitably used as guides or used for marking purposes for positioning of the openings 34 through the cavitation plate 11.

Preferably the trailing edges 22 of the opposite pair of hydrofoils 10 will be aligned. The trailing edges 22 may be suitably aligned by the use of a straight edge. The trailing edges 22 are located approximately 2½ inches rearward of the cavitation plate 11.

Mounting of the pair of hydrofoils 10 may then occur by positioning the mounting sides 16 on top of the cavitation plate 11, proximal to the drive shaft housing 12. Alignment of the openings 30, 31, and 32 with the openings 34 may then occur. The trailing edges 22 will be mounted proximal to the propeller 14. The hydrofoils 10 are mounted such that the leading edges 24 are extending upward from the plane of the hydrofoils 10 and the trailing edges 22 are extending downward therefrom.

Stainless steel washers and threaded bolts 38 may suitably be passed upward through the aligned openings 30, 31, 32, and 34 for threaded engagement with washers 38 and/or stainless steel nuts 40 located above the cavitation plate 11. The bolts 38 and nuts 40 may then be tightened thereby rigidly and removably affixing the hydrofoils 10 to the cavitation plate 11.

The hydrofoils 10, bolts 38, washers 36, and nuts 40 are preferably constructed of stainless steel metal, or other non-corrosive metals. However, it is also possible to use other materials which remain resistant to corrosion when exposed to water.

Prior to the propulsion of a boat, the motor and drive shaft housing 12 are generally in a vertical position with the hydrofoils 10 remaining in a general horizontal position. When the motor is engaged, propulsion of the boat will occur as the rotation of the propeller 14 begins as known in the art. As the power applied by the motor increases and the propeller rotates more rapidly, the bow of a boat will lift above the surface of the water and the stern of a boat will sink lower into the water. During this period the hydrofoils 10 will be pivoted in a downward direction, with the leading edge 24 higher relative to the trailing edge 22. The hydrofoils 10 will then remain angularly disposed relative to the horizontal plane until such time as the boat achieves a planing configuration with respect to the surface of a body of water, which results in a return of the hydrofoils 10 back to a horizontal position. During the period of acceleration, prior to a boat "planing out," the trailing edge 22 functions as a drag-inducing flap with respect to water passing the hydrofoils 10. Water coming into contact with the hydrofoils 10, and particularly the trailing edges 22, will cause a lifting force to be applied to the trailing edges 22. The lifting force then causes the hydrofoils 10 to pivot upward, thereby assisting the boat to more rapidly achieve a planar configuration.

The hydrofoils 10 will remain angularly disposed with respect to a horizontal plane when a boat initiates a power takeoff or a boat accelerates while moving, commonly known as "in the hole." During these periods the hydrofoils 10 will maintain a steep angle of attack maximizing the lifting forces applied to the trailing edges 22. During these periods the leading edges 24 function to maximize the volume of water passing below the hydrofoils 10 for engagement with the trailing edges 22, thereby maximizing the lifting forces applied to the trailing edges 22 caused by water pressure forces. The size and shape of both the leading and trailing edges 24, 22 are preferably designed to maximize the lifting forces while the hydrofoil 10 remains at a steep angle of attack. In addition, the leading and trailing edges 24, 22 minimize drag to a boat and motor when the hydrofoil 10 remains at a shallow angle of attack which occurs when the boat is in planar configuration with respect to the surface of a body of water. Specifically the leading and trailing edges 24, 22 are designed to pass through water at a significant velocity without inducing any consequential drag forces to a boat or motor.

The hydrofoils 10 advance the acquisition of a planar configuration by a boat at significantly reduced rotations per minute of a propeller 14, and reduce the time required for a boat to plane out following power takeoff or acceleration out of the hole. In addition, the hydrofoils 10 improve the ability of a boat to trim in shallow or deep water and eliminate the need for additional propellers 14 for use in varying operating conditions. The hydrofoils 10 also enhance the velocity of a boat by reducing the rotations per minute required to maintain a comparable speed to a motor not equipped with the hydrofoils 10. The hydrofoils 10 also enhance the ability of a boat to "plane out" when the boat is operated with many passengers or more gross weight load on board.

The outboard motor hydrofoils 10 improve the efficiency of an outboard motor propulsion system. In use, the hydrofoils 10 save fuel and engine wear by maintaining a given speed at reduced engine rotations per minute as compared to an outboard motor not equipped with the hydrofoils 10. The inclusion of the hydrofoils 10 promote a smooth ride and comfort to passengers by reducing bouncing of a boat during use in rough water operating conditions. The hydrofoils 10 assist in maintaining the bow in a planar configuration at increased speeds and during rough water conditions. Wear occurring to a boat is thereby reduced, providing the boat and outboard motor with increased useful life. The hydrofoils 10 also reduce propeller cavitation which occurs during high velocity turns.

Significantly enhanced visibility results when a boat acquires a planar configuration in a reduced period of time. Safety of boat operation is thereby improved. Use of the hydrofoils 10 eliminates the necessity for a boat operator to remain standing in order to visualize the boat's course during power takeoff. In addition, the hydrofoils 10 improve the safety of boat operation by enhancing the control, handling, and performance of the boat in adverse operating conditions.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An improved hydrofoil for use with a conventional outboard motor having a cavitation plate, comprising:
- a pair of substantially planar fins further comprising, parallel mounting and second sides,
- parallel forward and trailing edges, and
- a leading edge extending between said forward edge and said second side,
  - said trailing edges having downturned angle portions depending at a 12° angle from said substantially planar fins, and
  - said leading edges having upturned angle portions extending at a 12° angle from said substantially planar fins.

2. A pair of fins according to claim 1, wherein said pair of fins are mirror images of each other.

3. A pair of fins according to claim 2 wherein said mounting edges have a plurality of openings suitably adapted for engagement with the cavitation plate of an outboard motor.

4. A pair of fins according to claim 3, wherein said fins are comprised of stainless steel or aluminum.

5. A pair of substantially planar fins further comprising,
- parallel mounting and second sides,
- parallel forward and trailing edges, and
- a leading edge extending between said forward edge and said second side,
- said trailing edges having downturned angle portions, and
- said leading edges having upturned angle portions.

6. A pair of fins according to claim 5, wherein said pair of fins are mirror images of each other.

7. A pair of fins according to claim 6, wherein said mounting edges have a plurality of openings suitably adapted for engagement with the cavitation plate of an outboard motor.

8. A pair of fins according to claim 7, wherein said fins are comprised of stainless steel or aluminum.

* * * * *